United States Patent [19]

Hennemann et al.

[11] 4,348,305

[45] Sep. 7, 1982

[54] LIQUID DETERGENT COMPOSITIONS COMPRISING MIXTURES OF ALKYL POLYGLYCOL ETHERS AND QUATERNARY AMMONIUM FABRIC SOFTENING AGENTS

[75] Inventors: Manfred Hennemann, Hilden; Albrecht Löhr, Ratingen, both of Fed. Rep. of Germany

[73] Assignee: Henkel Kommanditgesellschaft auf Aktien, Düsseldorf-Holthausen, Fed. Rep. of Germany

[21] Appl. No.: 243,503

[22] Filed: Mar. 13, 1981

Related U.S. Application Data

[63] Continuation of Ser. No. 32,467, Apr. 23, 1979, abandoned.

[30] Foreign Application Priority Data

Apr. 24, 1978 [DE] Fed. Rep. of Germany ..... 2817834

[51] Int. Cl.[3] ..... C11D 1/835; C11D 1/62; D06M 13/46

[52] U.S. Cl. ..... 252/542; 252/8.8; 252/8.75; 252/174.22; 252/545; 252/547

[58] Field of Search ..... 252/8.75, 8.8, 8.9, 252/106, 153, 174.21, 174.22, 545, 542, 547, DIG. 1, DIG. 14

[56] References Cited

U.S. PATENT DOCUMENTS

| | | | |
|---|---|---|---|
| 3,682,849 | 8/1972 | Smith et al. | 260/615 B |
| 3,691,081 | 9/1972 | Thompson et al. | 252/174.22 |
| 3,983,078 | 9/1976 | Collins | 252/540 |
| 4,038,196 | 7/1977 | Minegishi et al. | 252/8.8 |
| 4,058,473 | 11/1977 | Canter | 252/121 |
| 4,129,514 | 12/1978 | Caffarel et al. | 252/174.22 |
| 4,132,680 | 1/1979 | Nicol | 252/547 |
| 4,140,641 | 2/1979 | Ramachandran | 252/8.75 |
| 4,144,177 | 3/1979 | Minegishi et al. | 252/8.8 |
| 4,147,649 | 4/1979 | Arnau et al. | 252/539 X |
| 4,222,905 | 9/1980 | Cockrell | 252/547 |
| 4,248,729 | 2/1981 | Rubingh | 252/174.22 |
| 4,259,217 | 3/1981 | Murphy | 252/547 |

FOREIGN PATENT DOCUMENTS

| | | |
|---|---|---|
| 2426581 | 12/1974 | Fed. Rep. of Germany . |
| 2303850 | 11/1976 | France . |
| 2342364 | 10/1977 | France . |
| 830864 | 3/1960 | United Kingdom . |

*Primary Examiner*—P. E. Willis, Jr.
*Attorney, Agent, or Firm*—Hammond & Littell, Weissenberger and Muserlian

[57] ABSTRACT

An improved liquid detergent composition is comprised of:

(a) from about 5 to 18% by weight of a mixture of alkyl polyglycol ethers;

(b) from about 5 to 18% by weight of a second mixture of alkyl polyglycol ethers, the quantitative ratio of (a) to (b) being from about 2:1 to 1:2; and (c) from about 2.5 to 10% by weight of a fabric-softening quaternary ammonium salt.

17 Claims, No Drawings

LIQUID DETERGENT COMPOSITIONS COMPRISING MIXTURES OF ALKYL POLYGLYCOL ETHERS AND QUATERNARY AMMONIUM FABRIC SOFTENING AGENTS

This is a continuation of U.S. patent application Ser. No. 32,467 filed Apr. 23, 1979 now abandoned.

FIELD OF THE INVENTION

The present invention concerns a stable liquid detergent with fabric softening action for simultaneously washing and softening delicate fabrics in a washing machine or during washing by hand.

BACKGROUND OF THE INVENTION

There has long been a need for a liquid, fabric-softening, fine detergent which imparts to fabrics during the washing process desirable softening and antistatic properties. Because of the known incompatibility of conventional fabric softeners of the type of quaternary ammonium or imidazolinium compounds with anionic surfactants, it has not been possible to use anionic surfactants in these liquid preparations. Therefore, combinations of nonionic surfactants and quaternary ammonium compounds have been used. Such combinations are described in, for example, British Pat. No. 830,864, which discloses liquid detergents containing nonionic surfactants and quaternary ammonium compounds having a long-chained alkyl radical and three short-chained alkyl radicals. According to the Journal *Seifen-Oele-Fette Wachse* (1963), 4, p. 78, the washing power of these combinations of nonionic surfactant and quaternary ammonium compound is particularly good if the ratio of the nonionic surfactant to the quaternary ammonium compound is in a quantitative ratio of 4:1 to 1:1.

Other nonionic surfactant-quaternary ammonium compound compositions are known. For example, DOS No. 2,426,581 describes a combination of a nonionic surfactant, a customary softening quaternary ammonium compound with one or two long-chained alkyl radicals, as well as another quaternary ammonium compound with one methyl group, one or two long-chained alkyl groups, and one or two polyglycol ether groups. A liquid detergent comprised of a nonionic surfactant of the type of alkyl polyglycol ethers or alkylphenol polyglycol ethers, and a conventional fabric softener of the type of difat-alkyl-dimethyl-ammonium halides, as well as of a fatty acid polyglycol diester, is known from DOS No. 2,529,444.

These liquid detergent compositions have not, however, been satisfactory, because no balance between washing power, fabric softening capacity, and sudsing behavior, could be achieved. Moreover, there has been no suggestion in the art as to the optimum composition of a liquid detergent to obtain an optimum combination of the desired properties. Rather, the man skilled in the art has had to assume that a wash-active surfactant would detach the fabric softener contained in the wash liquor together with the soil from the textile fibers and remove it altogether so that the desired fabric-softening effect would not be achieved; conversely, good softening effect would be achieved only with a surfactant having insufficient cleaning ability.

OBJECTS OF THE INVENTION

An object of this invention is to provide a liquid detergent for delicate fabrics having an optimum of washing ability, fabric-softening properties, and sudsing behavior, which can be used both in the washing machine and in washing by hand.

Another object of the invention is the development of an improved liquid detergent comprising:

(a) from about 5 to 18% by weight of a mixture of alkyl polyglycol ethers of the formula

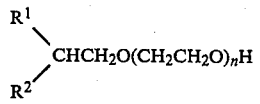

$$\begin{matrix} R^1 \diagdown \\ \qquad CHCH_2O(CH_2CH_2O)_nH \\ R^2 \diagup \end{matrix} \qquad (I)$$

wherein $R^1$ represents a linear alkyl radical; $R^2$, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 11 to 15, and n represents an average value of from about 5 to 9, n being a value such that the ethylene oxide portion of the alkyl polyglycol ethers represents from about 50 to 65% by weight, based on the total weight of the mixture of alkyl polyglycol ether;

(b) from about 5 to 18% by weight of a mixture of alkyl polyglycol ethers of formula I, wherein $R^1$ represents a linear alkyl group; $R^2$ is a hydrogen atom or, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 6 to 10; and n represents an average value of from about 3 to 8, n being of such a value that the ethylene oxide portion of the alkyl polyglycol ethers represents from about 55 to 70% by weight, based on the total weight of the mixture of alkyl polyglycol ethers, the quantitative ratio of (a) to (b) being from about 2:1 to 1:2; and (c) from about 2.5 to 10% by weight of a fabric-softening quaternary ammonium salt.

DESCRIPTION OF THE INVENTION

This invention is directed to liquid detergents having an optimum combination of washing ability, fabric-softening properties, and sudsing behavior. The liquid detergents contain (i) two different non-ionic surfactants and (ii) fabric-softening substances. More particularly, the liquid detergents are comprised of:

(a) from about 5 to 18% by weight, based on the total weight of the composition, of a mixture of alkyl polyglycol ethers of the formula

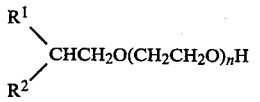

$$\begin{matrix} R^1 \diagdown \\ \qquad CHCH_2O(CH_2CH_2O)_nH \\ R^2 \diagup \end{matrix} \qquad (I)$$

wherein $R^1$ represents a linear alkyl radical; $R^2$, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 11 to 15; and n represents an average value of from about 5 to 9, n being a value such that the ethylene oxide portion of the alkyl polyglycol ethers represents from about 50 to 65% by weight, based on the total weight of the mixture of alkyl polyglycol ethers;

(b) from about 5 to 18% by weight, based on the total weight of the composition, of a mixture of alkyl polyglycol ethers of formula I, wherein $R^1$ represents a linear alkyl group; $R^2$ is a hydrogen atom or, in from about 20 to 75% of said alkyl polyglycol ethers, represents a $C_1$ to $C_4$ alkyl group and, in from about 25 to 80% of said alkyl polyglycol ethers, $R^2$ represents a hydrogen atom, the total number of carbon atoms in $R^1$ and $R^2$ together being from about 6 to 10; and n represents an average value of from about 3 to 8, n being of such a value that the ethylene oxide portion of the alkyl polyglycol ethers represents from about 55 to 70% by weight, based on the total weight of the mixture of alkyl polyglycol ethers, the quantitative ratio of (a) and (b) being from about 2:1 to 1:2; and (c) from about 2.5 to 10% by weight, based on the total weight of the composition, of a fabric-softening quaternary ammonium salt.

The alkyl polyglycol ethers of formula I which are suitable according to the invention as component (a) are derived from alcohols obtained by reacting linear olefins with carbon monoxide and hydrogen according to known methods of hydroformulation and subsequent hydration. The reaction products, which comprise a mixture of branched and linear compounds, are known as oxo-alcohols. Commercial oxo-alcohol mixtures which are suitable for the preparation of surfactant component (a) are, e.g., the oxo-alcohol mixtures of Deutsche Shell Chemie Gesellschaft, available under the tradename "Dobanol", which have about 25% by weight of 2-alkyl branchings. Other suitable oxo-alcohol mixtures having from about 50 to 70% by weight of 2-alkyl branchings are available under the name "Synprol" from Imperial Chemical Industries Ltd. Other suitable products based on oxo-alcohols are, e.g., various "Lutensol" types from BASF, which products have from about 30 to 35% by weight of branched alcohols, and some "Lial" types from Liquichimica S.p.A., which contain about 60% by weight of branched alcohols.

Alkyl polyglycol ethers are prepared from the above-mentioned mixtures of oxo-alcohols by means of known methods of ethylene oxide condensation. According to the methods, the alkyl polyglycol ether mixtures will be comprised of compounds which will not all have the same number of ethylene oxide units, or groups. For example, as a result of the ethylene oxide condensation of a mixture of certain oxo-alcohols, a resulting mixture of alkyl polyglycol ethers wherein n, according to Formula I, represents an average value of 6, may very well be comprised of oxo-alcohols having from about 3 to about 9 ethylene oxide groups.

Alkyl polyglycol ethers having from about 13 to 15 carbon atoms and an average ethylene oxide content of about 55 to 65% by weight, are preferred for component (a). Typical preferred commercially available products are, e.g., "Dobanol 45-7", which consists of at least 95% of $C_{14/15}$-oxo-alcohol with an average of 7 moles of ethylene oxide, and "Lutensol AO 8", which represents a $C_{13/15}$-oxo-alcohol ethoxylate with an average of 8 moles of ethylene oxide.

Preferred component (b) compounds are alkyl polyglycol ethers whose alcohol base represents natural or synthetic primary fatty alcohols or oxo-alcohols containing from about 9 to 12 carbon atoms and from about 60 to 70% by weight of ethylene oxide. Typical preferred products are, e.g., the commercial product "Marlipal KF" (from Chem. Werle Huels), which represents a $C_{10}/C_{12}$-fatty alcohol-ethoxylate with an average of 6 moles of ethylene oxide, as well as "Lutensol ON 70", which represents a $C_9/C_{11}$-oxo-alcohol ethoxylate with an average of 7 moles of ethylene oxide. Among the suitable fatty alcohols which form the basis of preferred alkyl-polyglycol ethers are the alcohols commercially available from Henkel KOaA under the tradename "Lorol C - 8 to 12".

The ratio of the amount of component (a) employed to the amount of component (b) employed, substantially determines washing ability, sudsing behavior, and softening action of the liquid detergent composition. Optimum results are obtained if the weight ratio of (a) to (b) is between about 2:1 and 1:2.

In general, component (a) and component (b) are used in combined amounts of from about 10 to 30% by weight, based on the total weight of the liquid detergent, an amount of from about 15 to 30% by weight being preferred.

The fabric-softening quaternary ammonium salts useful in this invention comprise derivatives of ammonia or imidazoline having at least one quaternary nitrogen atom. Preferably the derivatives will have two long-chain aliphatic radicals in the molecule, each of such radicals having from about 14 to 26 carbon atoms, most preferably from about 16 to 20 carbon atoms. The long-chained aliphatic radicals can be linear or branched and can be derived accordingly from fatty acids, or fatty amines, Guerbet amines, or from alkyl amines obtained by the reduction of nitroparaffins.

Useful fabric-softening quaternary ammonium salts are obtained by alkylation of long-chained secondary amines. Such useful compounds include, for example, distearyl-dimethylammonium chloride or ditallow-alkyl-dimethylammonium chloride. Imidazoline derivatives that are useful can be obtained by reacting 1 mole of an aminoalkyl-ethylene diamine or hydroxyalkyl ethylene diamine with 2 moles of a long-chained $C_{14}/C_{26}$ fatty acid or its ester, and then converting the reaction product by alkylation to the quaternary imidazolinium compounds. In the above quaternary ammonium and imidazolium compounds, the acid radical anion, which results from the alkylating agents used in quaternization, is significant with regard to the effectiveness of the fabric softener. For example, the anion can be selected from the group of chloro, bromo, methyl sulfato, ethyl sulfato, methane sulfonato, ethane sulfonato, and toluene sulfonato groups. Preferably the anion is a chloro and/or methyl sulfato group. Typical preferred fabric softeners are, e.g., ditallow-alkyl-dimethylammonium chloride (which is commercially available as "Praepagen WK" and "Praepagen WKT" from Hoechst, and as "Adogen 442" from Ashland); distearyl-dimethylammonium chloride (which is commercially available as "Arosurf TA 100" from Ashland); and 2-heptadecyl-1-methyl-1-oleoylamide ethylimidazolinium methosulfate.

The liquid detergents of this invention are also comprised of other components such as water, organic solvents, stabilizers, solubilizers, preservatives, enhancers, and the like. Water is the preferred additional component; however one or more water-miscible organic solvents, such as lower alkanols or lower alkane diols or lower alkane polyols, can be used in addition to water. The water-miscible organic solvents include, for example, ethanol, isopropyl alcohol, ethylene glycol, propylene glycol, and glycerin. Also, the polyol ether compounds can be used such as lower alkoxy-lower alkanols and lower alkoxy-lower alkoxy-lower alkanols like methyl, ethyl, or butyl ethers of diethylene glycol or their acetates (e.g., products available under the tradename "Cellosolve" from Union Carbide Corp.). Water can comprise from about 35 to 85% by weight, based on the total weight of the liquid detergent, and water-miscible organic solvents can be present in amounts up to 20% by weight, preferably 16% by weight. The preferred lower limit for the water-miscible organic solvents is on the order of 5% by weight.

To improve the solubility of the components, it is frequently advisable to use solubilizers, so-called hydrotropes, in addition to, or instead of, the above-mentioned organic solvents. The preferred hydrotropes are non-surfactant, organic sulfonates, e.g., $C_6$–$C_{10}$ alkanesulfonates, as well as the salts of toluene-, xylene- or cumene-sulfonic acid, preferably the alkanolamine or alkali salts, most preferably the potassium salts. Urea is also suitable as a hydrotrope. Hydrotropes are added in amounts of from about 2 to 12% by weight, preferably from about 3 to 9% by weight, based on the total weight of the liquid detergent.

Additional auxiliary substances, such as, for example, opacifiers and viscosity standardizing agents, can be added to the detergents of this invention to improve certain properties. These additives include, for example, esters of alkanols or partial esters of polyols with long-chained fatty acids, like palmitic or stearic acid. A typical product is ethylene glycol stearate. These additives are present in small amounts, preferably from about 0.05 to 2.0% by weight, based on the total weight of the liquid detergent.

The liquid detergent may contain a small amount of a preservative such as, for example, formalin. The preservative will preferably be present in an amount of from about 0.05 to 1.0% by weight, based on the total weight of the liquid detergent.

Discoloration of the liquid detergent compositions can occur upon prolonged storage due to, for example, contamination with heavy metal ions during manufacture. To avoid such discoloration, sequestrants for heavy metal ions can be added. Such sequestrants include the sodium, potassium, or triethanolamine salts of aminopolycarboxylic acids, such as ethylene diamine tetraacetic acid or nitrilotriacetic acid. Such sequestrants are used in small amounts, preferably in amounts of from about 0.1 to 1.0% by weight, based on the total weight of the liquid detergent.

Perfumes or dyes can be also added to the liquid detergent composition. Useful perfumes include substances with a flowery, fresh, or fruity odor or with a nuance known as "cosmetic" or "creamy". Useful dyes include, for example, red xanthene dyes such as rhodamine B extra.

The liquid detergent compositions of this invention are formed by admixing components (a), (b), and (c) with water and additional additives and converting the admixture into a stable dispersion. This can be effected in a conventional manner by agitation—at elevated temperatures, if necessary—by means of agitators, dispersers, homogenizers, or the like. Preferably, distilled or demineralized water is used.

The detergents according to the invention can be used for simultaneously washing and softening delicate articles of wool, synthetic fibers, such as polyester, polyacrylic nitrile, and polyamide, and blends of wool and synthetic fibers. The washing and softening process can take place either in the washing machine or in hand washing, preferably at temperatures of up to about 40° C. The concentration of the preparations is generally from about 2 to 20 ml of liquid detergent per liter of wash liquor, preferably from about 3 to 6 ml per liter. The liquid detergents are characterized in that they clean the fabric properly and impart to them at the same time a pleasant feel and anti-electrostatic properties. During washing by hand in, for example, a sink, pleasant suds are formed; during washing in a washing machine, no oversudsing is observed. In addition, the suds can be rinsed out easily.

EXAMPLES

The following examples set forth the composition of several liquid detergents within the scope of the invention which were tested for their washing ability, softening properties, and sudsing behavior during washing by hand and in machine washing.

| Component | Percent by Weight |
|---|---|
| EXAMPLE 1 | |
| Dobanol 45-7[1] | 11.5 |
| Lorol $C_{10}/C_{12}$ 6Ao[2] | 11.5 |
| Adogen 442[3] | 3.5 |
| Ethanol/isopropyl alcohol mixture | 5.0 |
| $H_2O$ | balance |
| EXAMPLE 2 | |
| Dobanol 45-7 | 12.5 |
| Lutensol ON 70[4] | 12.5 |
| Praepagen WK[5] | 3.0 |
| Ethanol/isopropyl alcohol mixture | 5.0 |
| 1,2-propylene glycol | 5.0 |
| $H_2O$ | balance |
| EXAMPLE 3 | |
| Dobanol 45-7 | 5.5 |
| Marlipal KF[6] | 16.5 |
| Praepagen WKT[7] | 4.0 |
| Ethanol | 3.0 |
| 1,2-propylene glycol | 3.0 |
| Tetrasodium salt of ethylenediaminetetraacetic acid | 0.2 |
| Ethylene glycol stearate | 0.3 |
| Formalin (35% by weight aqueous solution) | 0.1 |
| Rhodamine B extra | 0.00006 |
| Perfume oil, flowery/fresh odor | 0.5 |
| $H_2O$ | balance |

[1] $C_{14}/C_{15}$-oxo-alcohol ethoxylate having an average of 58% by weight ethylene oxide content (available from Deutsche Shell Chemie Gesellschaft).
[2] $C_{10}/C_{12}$ fatty alcohol ethoxylate having an average of 60% by weight ethylene oxide content (available from Henkel KCaA).
[3] Composition comprised of 75% by weight of ditallow-alkyl-dimethylammonium chloride in liquid form and 25% by weight isopropyl alcohol and water (available from Ashland).
[4] Mixture of $C_9$ and $C_{11}$-oxo-alcohol ethoxylate having an average ethylene oxide content of 66% by weight (available from BASF).
[5] Composition comprised of 75% by weight of ditallow-alkyl dimethylammonium chloride in paste form and 25% by weight of isopropyl alcohol and water (available from Hoechst).
[6] $C_{10}/C_{12}$-fatty alcohol ethoxylate having an average of 60% by weight ethylene oxide content (available from Chem. Werke, Huels).
[7] Composition comprised of 75% by weight of ditallow-alkyl-dimethylammonium chloride in liquid form and 25% by weight of isopropyl and water (available from Hoechst).

A preparation having the above composition represents a typical, ready-made liquid detergent according to the invention containing the usual additives in the customary amounts.

| Component | Percent by Weight |
|---|---|
| EXAMPLE 4 | |
| Dobanol 45-7 | 15.0 |
| Markipal KF | 10.0 |
| Arousurf TA 100[8] | 3.5 |
| Ethanol | 5.0 |
| 1,2-propylene glycol | 10.0 |
| $H_2O$ | balance |
| EXAMPLE 5 | |
| Lutensol AO 8[9] | 13.0 |
| Marlipal KF | 11.0 |
| Praepagen WK | 4.0 |
| Ethanol/isopropyl alcohol mixture | 5.0 |
| 1,2-propylene glycol | 7.0 |
| $H_2O$ | balance |
| EXAMPLE 6 | |
| Dobanol 45-7 | 15.0 |
| Lutensol ON 70 | 11.0 |
| Praepagen WK | 3.0 |
| Ethanol/isobutanol alcohol mixture | 5.0 |
| 1,2-propylene glycol | 9.0 |
| $H_2O$ | balance |
| EXAMPLE 7 | |
| Lutensol AO 8 | 11.0 |
| Lutensol ON 70 | 14.0 |
| Praepagen WKT | 5.0 |
| Ethanol/isopropyl alcohol mixture | 4.0 |
| 1,2-propylene glycol | 4.5 |
| $H_2O$ | balance |

[8]Powder comprised of 95% by weight of distearyl-dimethylammonium chloride (available from Ashland).
[9]$C_{13}/C_{15}$-oxo-alcohol ethoxylate having an average of 62% by weight ethylene oxide (available from BASF).

The liquid detergent compositions of Examples 1 to 7 were tested according to known techniques for washing ability, fabric-softening action, and sudsing behavior. The performance of each such detergent was measured with regard to the washing of delicate fabrics in a washing machine and by hand washing, at temperatures up to about 40° C. It was found that each such detergent exhibited an optimum combination of properties with regard to washing ability, fabric-softening action, and sudsing behavior, i.e., each detergent performed well in each area without sacrifice in another area.

The above Examples are set forth for the purpose of demonstrating the invention herein and are not to be construed as limiting the invention thereto.

We claim:

1. A liquid detergent having an optimum combination of washing ability, fabric softening action, and sudsing behavior, said liquid detergent comprising:

(a) from about 5 to 18% by weight of a mixture of alkyl polyglycol ethers of the formula

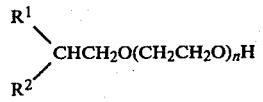

(I)

wherein $R^1$ represents a linear alkyl radical; $R^2$, in from about 20 to 75% of said alkyl polyglycol ethers, represents a $C_1$ to $C_4$ alkyl group and, in from 25 to 80% of said alkyl polyglycol ethers, represents a hydrogen atom, the total number of carbon atoms in $R^1$ and $R^2$ together being from about 11 to 15; and wherein n represents an average value of from about 5 to 9, n being a value such that the ethylene oxide portion of the alkyl polyglycol ether represents from about 50 to 65% by weight, based on the total weight of the alkyl polyglycol ether;

(b) from about 5 to 18% by weight of a mixture of alkyl polyglycol ethers of Formula I, wherein $R^1$ represents a linear alkyl group; $R^2$ is a hydrogen atom or, in from about 20 to 75% of said alkyl polyglycol ethers, represents a $C_1$ to $C_4$ alkyl group and, in from about 25 to 80% of said alkyl polyglycol ethers, represents a hydrogen atom, the total number of carbon atoms in $R^1$ and $R^2$ together being from about 6 to 10; and wherein n represents an average value of from about 3 to 8, n being of such a value that the ethylene oxide portion of the alkyl polyglycol ether represents from about 55 to 70% by weight, based on the total weight of the alkyl polyglycol ether, the quantitative ratio of (a) to (b) being from about 2:1 to 1:2; and (c) from about 2.5 to 10% by weight of a fabric-softening quaternary ammonium salt.

2. The liquid detergent composition of claim 1 wherein component (a) plus component (b) represent from about 10 to 30% by weight, based on the total weight of the composition.

3. The liquid detergent composition of claim 2 wherein component (a) plus component (b) represent from about 15 to 30% by weight, based on the total weight of the composition.

4. The liquid detergent composition of claim 1 wherein $R^1$ and $R^2$ of component (a) together contain from about 11 to 13 carbon atoms.

5. The liquid detergent composition of claim 1 wherein the ethylene oxide portion of component (a) represents from about 55 to 60% by weight, based on the total weight of component (a).

6. The liquid detergent composition of claim 1 wherein $R^1$ and $R^2$ of component (b) together contain from about 8 to 10 carbon atoms.

7. The liquid detergent composition of claim 1 wherein the ethylene oxide portion of component (b) represents from about 55 to 65% by weight, based on the total weight of component (b).

8. The liquid detergent composition of claim 1 wherein component (c) is a derivative of ammonia or imidazoline.

9. The liquid detergent composition of claim 1 or 8 wherein component (c) contains two long-chain aliphatic radicals.

10. The liquid detergent composition of claim 1 wherein component (c) is a quaternary ammonium salt whose atom is selected from the group of chloro, bromo, methyl sulfato, ethyl sulfato, methane sulfonato, ethane sulfonato, or toluene sulfonato groups.

11. The liquid detergent composition of claim 1 or 10 wherein component (c) is a ditallow-alkyl-dimethylammonium or distearyl-dimethylammonium salt.

12. The liquid detergent composition of claim 11 wherein component (c) is distallow-alkyl-dimethylammonium chloride or distearyl-dimethylammonium chloride.

13. The liquid detergent composition of claim 1 which also is comprised of water.

14. The liquid detergent composition of claim 1 comprised of:

(a) from about 10 to 12.5% by weight of an alkyl polyglycol ether of Formula I wherein $R^1$ and $R^2$ together contain from about 11 to 13 carbon atoms and wherein the average ethylene oxide content of the alkyl polyglycol ether is from about 55 to 65% by weight, based on the total weight of the alkyl polyglycol ether;

(b) from about 10 to 12.5% by weight of an alkyl polyglycol ether of Formula I wherein $R^1$ contains from about 7 to 10 carbon atoms, $R^2$ is a hydrogen atom, and the average ethylene oxide portion of the alkyl polyglycol ether is from about 60 to 70% by weight, based on the weight of the alkyl polyglycol ether;

(c) from about 2.5 to 5% by weight of a ditallow-alkyl-dimethylammonium salt, based on the total weight of the composition; and (d) balance to 100% of water, water-miscible organic solvents, hydrotropic agents, dyes, perfumes, heavy metal sequestrants, preservatives, opacifiers, or viscosity standardizing agents, or a mixture thereof, wherein water comprises from about 35 to 85% by weight.

15. The liquid detergent composition of claim 14 wherein component (c) is the chloride or methyl sulfate salt.

16. The liquid detergent composition of claim 1, wherein component (c) is a derivative of ammonia or imidazoline having at least one quaternary nitrogen and having two long-chain aliphatic radicals, each of said radicals having from about 14 to 26 carbon atoms.

17. The liquid detergent composition of claim 1, wherein component (c) is obtained (i) by alkylation of a long-chained secondary amine or (ii) by reacting 1 mole of an aminoalkyl-ethylene diamine or hydroxyalkyl ethylene diamine with 2 moles of a long-chained $C_{14}/C_{26}$ fatty acid or ester thereof and then alkylating the reaction product.

* * * * *

UNITED STATES PATENT AND TRADEMARK OFFICE

CERTIFICATE OF CORRECTION

PATENT NO. : 4,348,305

DATED : September 7, 1982

INVENTOR(S) : Manfred Hennemann et al.

It is certified that error appears in the above-identified patent and that said Letters Patent is hereby corrected as shown below:

The term of this patent subsequent to June 15, 1999, has been disclaimed.

Signed and Sealed this

*Seventh* Day of *December 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,348,305

DATED : September 7, 1982

INVENTOR(S) : MANFRED HENNEMANN et al.

It is certified that error appears in the above-identified patent and that said Letters Patent is hereby corrected as shown below:

Column 4, line 9, "KOaA" should read -- KGaA --.

Column 7, line 7, "Markipal" should read -- Marlipal --.

Claim 12, line 2, "distallow-alkyl-dimethyl-" should read -- ditallow-alkyl-dimethyl- --.

Claim 16, line 3, "nitrogen" should read -- nitrogen atom --.

Signed and Sealed this

*First* Day of *March 1983*

[SEAL]

*Attest:*

GERALD J. MOSSINGHOFF

*Attesting Officer*

*Commissioner of Patents and Trademarks*